US005727418A

United States Patent [19]

Strozier

[11] Patent Number: 5,727,418

[45] Date of Patent: Mar. 17, 1998

[54] DENT REMOVING TOOL

[75] Inventor: Robert E. Strozier, Woodstock, Ga.

[73] Assignee: Body Buddy, Inc., Holly Springs, Ga.

[21] Appl. No.: 760,955

[22] Filed: Dec. 6, 1996

[51] Int. Cl.[6] ..... B21J 13/08

[52] U.S. Cl. ..... 72/457; 72/705

[58] Field of Search ..... 72/457, 705; 294/64.1, 294/64.2

[56] References Cited

U.S. PATENT DOCUMENTS

| | | | |
|---|---|---|---|
| 2,771,933 | 11/1956 | Edwards | 153/32 |
| 3,030,837 | 4/1962 | Chartier | 81/15 |
| 3,570,289 | 3/1971 | Smyers | 72/479 |
| 3,584,836 | 6/1971 | Brubaker | 254/124 |
| 3,712,106 | 1/1973 | Holsapple et al. | 72/309 |
| 3,719,347 | 3/1973 | Wolgast et al. | 72/705 |
| 3,728,891 | 4/1973 | Hall, Sr. | 72/705 |
| 3,744,291 | 7/1973 | Hagerty et al. | 72/325 |
| 3,779,057 | 12/1973 | Sonnenberg | 72/56 |
| 4,026,139 | 5/1977 | Glaser et al. | 72/705 |
| 4,753,104 | 6/1988 | Strozier | 72/457 |
| 5,109,739 | 5/1992 | Hull et al. | 81/463 |
| 5,575,165 | 11/1996 | Roseberry | 72/56 |

FOREIGN PATENT DOCUMENTS 954315 4/1964 United Kingdom .

*Primary Examiner*—Lowell A. Larson
*Assistant Examiner*—Ed Tolan
*Attorney, Agent, or Firm*—John S. Pratt; Mitchell G. Weatherly; Kilpatrick Stockton LLP

[57] ABSTRACT

A sheet metal working tool particularly adapted for vehicle body repair comprising a slide hammer assembly attached to a suction cup from which air is drawn through the assembly. The tool incorporates a compressed air-operated vacuum ejector functioning on the venturi principle into a stop on the end of the slide hammer assembly opposite the suction cup. The exhaust stream is effectively muffled and diffused through a collar of hard, rugged, porous material that fits within a channel in the surface of the vacuum ejector/stop and that completely covers the port through which the exhaust exists the vacuum ejector/stop. The suction cup is reinforced by an internally located stiffener, and shock loads that may damage the threaded connections among components of the tool are damped by a shock absorbing hose connected to the vacuum ejector/stop.

20 Claims, 3 Drawing Sheets

DENT REMOVING TOOL

BACKGROUND OF THE INVENTION

This invention relates to tools used for restoring the original contour of sheet metal, particularly that contained in the bodies of vehicles such as automobiles, trucks, aircraft, trailers, boats and the like. In particular, the invention relates to improvements in the dent removing tool disclosed in U.S. Pat. No. 4,753,104 to Strozier ("the '104 patent"), which is incorporated in this document by this reference.

Dent removing hand tools are well known in the prior art because it is frequently necessary to remove concave dents from panels and fenders of motor vehicles. Dents are often removed by hammering them out from the rear or by filling them with a material such as metal or plastic, which is later leveled to produce a smooth surface. It is frequently difficult, however, to obtain access to the rear of dented panels because door panels, fenders, and other structures are often enclosed or the rear is otherwise obstructed. Repair techniques involving fillers are time-consuming and expensive.

Consequently, a number of conventional tools have been developed to remove concave dents. Perhaps best known among these tools is a slide hammer or "slap" hammer with a screw-end The screw-end is first embedded in a hole in the panel, and pulling force is then applied by rapidly sliding a weight or hammer along a rod away from the screw and against a stop on the end of the rod opposite the screw. Typical of such conventional slide hammers are the ones described in U.S. Pat. No. 3,030,837 and U.S. Pat. No. 3,570,289. Such devices damage the panel being repaired by leaving a screw hole in it. Consequently, it has previously been suggested that a suction cup, as illustrated in FIG. 3 of U.S. Pat. No. 3,570,289, be substituted for the screw in a slide hammer dent removing tool.

By contrast, U.S. Pat. No. 3,584,836 illustrates a dent remover which uses a suction cup having a port through which a vacuum is drawn. The cup is pulled by a chain attached to the middle of the cup and to a hydraulically actuated stanchion. While U.S. Pat. No. 3,584,836 offers some advantages by utilizing a suction cup from which air is drawn by external means, it is a large, expensive, cumbersome structure which is not well adapted to removal of dents on all vehicle-body orientations or to convenient, speedy use.

By contrast, the '104 patent disclosed a dent removing hand tool using a suction cup and a partial vacuum that offered considerable advantages over prior tools. The '104 patent disclosed a hand tool that could be used in virtually any vehicle-body orientation. The tool of the '104 patent also did not require hydraulic equipment or vacuum pumps. Instead, it created vacuum in its suction cup using compressed air (which was already present in virtually every vehicle-body repair shop). Additionally, the tool of the '104 patent was highly portable, required no holes to be drilled in the dented panel, and was of extremely rugged construction, which enabled it to withstand the abusive environment existing in vehicle-body repair shops.

The embodiment disclosed in FIGS. 4–6 of the '104 patent utilized a suction cup mounted on the end of a sturdy tube or pipe along which a slide hammer traveled to contact a stop at the end of the tube opposite the suction cup. A partial vacuum was drawn within the suction cup through the tube. Integrated into the stop was a vacuum ejector, which incorporated a venturi valve that, using compressed air, generated vacuum in the tube and suction cup. High pressure air flowing through the venturi exited the vacuum ejector/stop through exhaust ports in its surface.

The high pressure exhaust stream exiting the dent removing tool of the '104 patent can be loud. In order to quiet the exhaust stream, the vacuum ejector/stop 44 of the '104 patent optionally included open cell plastic foam 64, such as the type used in bed pillows or plastic sponges, which was inserted into chamber 60. Because the exhaust stream exited the vacuum ejector/stop through unobstructed openings 62 of relatively small cross-sectional area, it exited with relatively high velocity, which could stir up debris and suspend it in the air immediately surrounding the user of the tool. This suspended debris could create a hazard for the user of the tool.

Additionally, as shown in FIG. 5 of the '104 patent, the internal passages in the vacuum ejector/stop were formed in such a manner that plugs 66 and 68 were needed to fill a portion of some of the passages. For example, plug 68 of the '104 patent and the opening that it filled were needed because open cell foam 64 could not be inserted into exhaust chamber 60 except through an opening like the one filled by plug 68. Adding these plugs required extra manufacturing time and cost. Additionally, the plugs were potential leak sites that could adversely effect the performance, ruggedness, and reliability of the tool, especially given the fact that the vacuum ejector/stop was subject to high impact by slide hammer 20 during use.

As best seen in FIG. 4 of the '104 patent, a quick release coupling and valve combination 74 directly connects to an air fitting 23 that is rigidly screwed into a mating bore in a jet body 46, which is in turn rigidly screwed into the end of the vacuum ejector/stop 44. This rigid connection among vacuum ejector/stop 44, jet body 46, air fitting 23, and coupling 74 results in shock loads generated when slide hammer 20 strikes vacuum ejector/stop being transferred directly to the threads in and on all these components. These shock loads may eventually wear the threads and render the components unusable.

Finally, it has been found that the backing plate (unnumbered) shown attached to the hammer-side of suction cup 16 in FIG. 4 of the '104 patent may break loose from its attachment to suction cup 16. This problem is caused by the shock loads that are transmitted through slide tube 18 into suction cup 16 and the backing plate. While the backing plate effectively bears loads applied toward the vehicle body (pushing the plate into suction cup 16), the backing plate bears none of the load applied in the other direction (pulling the plate away from suction cup 16). Rather, only the attachment between the backing plate and suction cup 16 is capable of bearing loads in the latter direction.

SUMMARY OF THE INVENTION

The present invention offers all the convenience and versatility of the dent removing tool disclosed in the '104 patent along with quieter operation and certain structural improvements resulting in increased reliability and durability. The tool operates with less noise because of the addition of an integrated muffler/diffuser structure in the vacuum ejector/stop. The muffler/diffuser of the present invention is a collar of hard, sturdy, porous material that surrounds a portion of the vacuum ejector/stop, is flush with its surface, and covers the exhaust port. Because the muffler/diffuser so effectively diffuses and muffles the exhaust stream, only one exhaust port is needed in the vacuum ejector/stop rather than the multi-port arrangement disclosed in the '104 patent. This single exhaust port arrangement is easier and less expensive to machine than the multi-port arrangement disclosed in the '104 patent.

Additionally, the air passages within the vacuum ejector/stop of the present invention are formed in such a manner that no plugs are required to be installed in the vacuum ejector/stop. All passages, except the exhaust port, are drilled through either the opening in one end of the vacuum ejector/stop that mates with the slide tube or the opening in the other end of the vacuum ejector/stop that mates with the high pressure air source. Thus, the vacuum ejector/stop may be manufactured with fewer steps, fewer parts, and at a lower cost. The absence of plugs also results in a more reliable, rugged vacuum ejector/stop that better withstands the abusive treatment that it may receive in a vehicle-body repair shop.

The structural improvements to the dent removing tool of the '104 patent which result in increased reliability and durability are the integration of a stiffener into an interior cavity of the suction cup and the addition of a shock absorbing hose that is interposed between the vacuum ejector/stop and the couplings on the end of the air supply hose. The suction cup is permanently molded to surround a metal stiffener. This integrated structure better withstands the repeated shock loads that occur when the tool is used to remove a dent than did the suction cup/backing plate combination used in the tool disclosed in the '104 patent. The shock absorbing hose damps the shock loads generated by the use of the tool and thus borne by all the couplings and fittings attached to the tool, which prevents premature wear (stripping) of the threaded connections of these couplings and fittings.

Accordingly, it is an object of the present invention to provide an inexpensive, highly portable, very effective, durable vehicle body working tool powered by compressed air which can remove concave dents from sheet metal panels without further damaging such panels and which is quieter, safer, more reliable, and more durable in use than previous tools.

It is a further object of the present invention to provide such a tool that may be produced with fewer parts and forming operations to result in a lower cost and higher reliability tool than previous tools.

Other objects and advantages of the present invention will become apparent by reference to the accompanying drawings and the following description and claims.

DETAILED DESCRIPTION OF THE DRAWINGS

Figure 1:
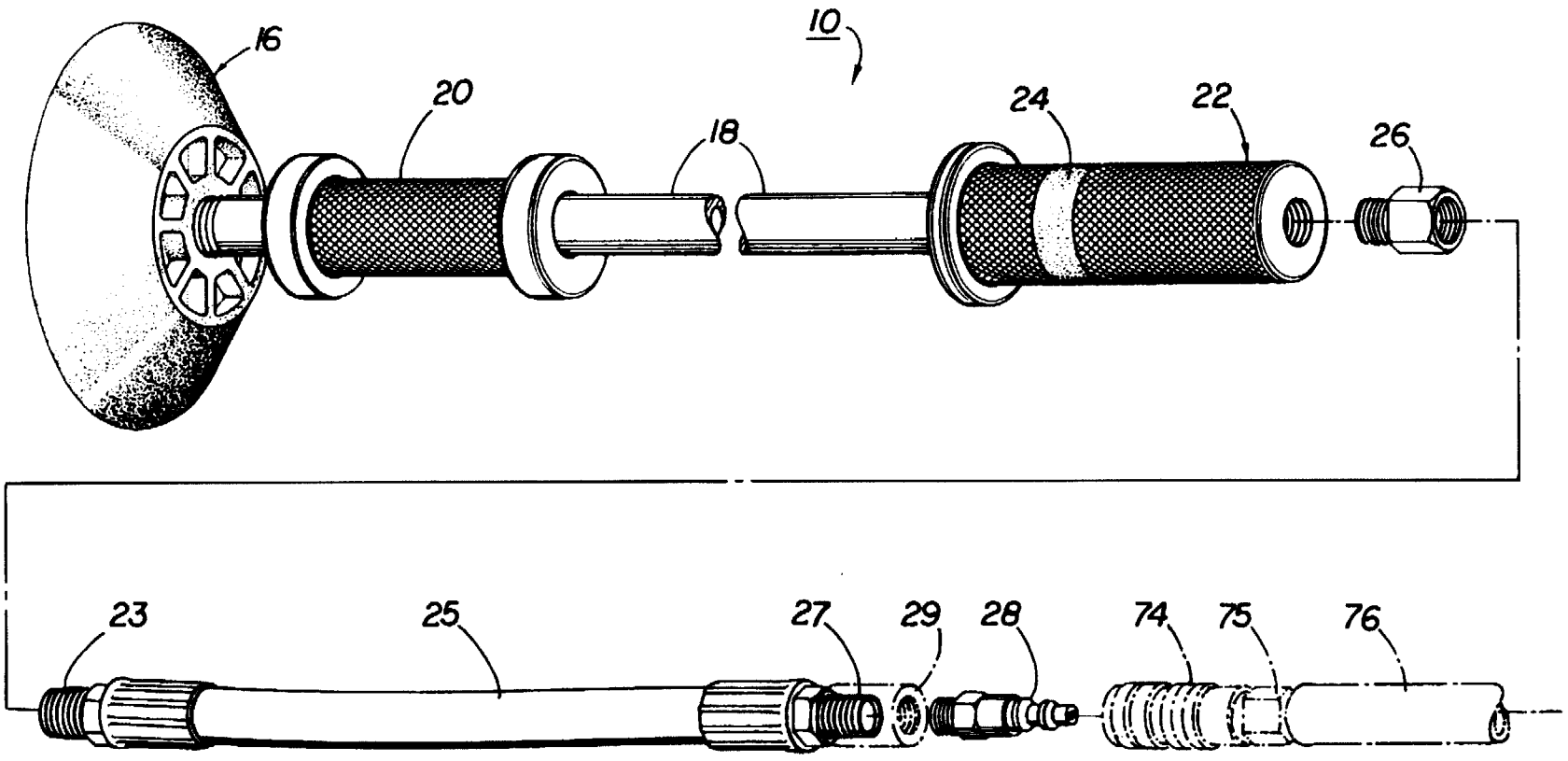
FIG. 1 is a perspective view of an embodiment of the present invention showing the slide hammer dent removing tool of the present invention, the location of the muffler/diffuser on the vacuum ejector/stop, a shock absorbing hose interposed between the vacuum ejector/stop and the air supply, and an internally stiffened suction cup.

As best illustrated by FIG. 1, slide hammer assembly 10 generally comprises suction cup 16 attached to one end of slide tube 18 along which hammer 20 slides in order to impact vacuum ejector/stop 22, which is made of impact steel, aluminum or other suitable material and is attached to the other end of slide tube 18. Vacuum ejector/stop 22 is connected to an internally threaded jet body 26. Fitting 23, which is mounted on one end of shock absorbing hose 25, has mating threads adapted to be connected to jet body 26. A fitting 27, which may be identical to fitting 23, is mounted to the other end of shock absorbing hose 25. Fitting 27 is adapted to be connected via coupling 75 to supply hose 76, which supply hose is connected to a high pressure air source (not shown). In order to improve the pressure fit of fittings 23 and 27 to their respective mating surfaces, fittings 23 and 27 are tapered such that their distal ends are of smaller diameter than their proximal ends. Shock absorbing hose 25 is interposed between coupling 75 and vacuum ejector/stop 22 in order to reduce the shock-induced wear of the mating threads of jet body 26, fittings 23 and 27, and coupling 75.

Optionally and as shown in FIG. 1, an adapter 29 and air fitting 28 may be interposed between fitting 27 and coupling/valve 74 to provide for a quick-release, threadless connection of slide hammer assembly 10 to the high pressure air source. Air fitting 28 may be adapted to mate with coupling/valve 74, which may be a coupling/valve combination like the Dynaquip DC-0 available from Dynaquip Controls, 1645 Mfg. Drive, Fenton, Mo. 63026. Not only does the combination of air fitting 28 and coupling/valve 74 provide a quick-release connection, but it also allows the user of slide hammer assembly 10 easily to adjust the pressure within suction cup 16. In such a combination, shock absorbing hose 25 further prevents premature wear of the threads within air fitting 28 and coupling/valve 74.

High pressure air is supplied to jet body 26 via fitting 23, shock absorbing hose 25, fitting 27, and supply hose 76, which is connected to the high pressure air source. A high pressure air source supplying 85 pounds per square inch pressure at a volume of 3.5 cubic feet per minute has been found to provide from about 26–29 inches Hg of vacuum in suction cup 16, which is a satisfactory vacuum level.

Figure 3:
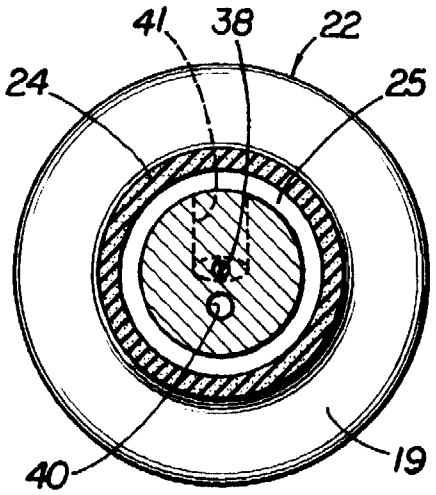
FIG. 3 is a sectional view taken along line 3—3 in FIG. 2.

The dent removing tool of the present invention employs a collar 24, which is preferably made of Porex #5285, or an equivalently hard, tough, and porous material, to diffuse the air exiting vacuum ejector/stop 22 and thereby reduce noise and the force of the air stream. As seen best in FIG. 2, collar 24 fits within a channel 27 that encircles a narrower, concentric channel 25. In FIG. 3, channel 25 and channel 27 (in which collar 24 rests) appear as concentric rings. Thus, air leaving exhaust port 41 may circulate through channel 25 before exiting vacuum ejector/stop 22 through collar 24.

Collar 24 offers several advantages when used as a muffler/diffuser over the use of open cell foam in an internal chamber. The use of collar 24 as a muffler rather than the open cell foam 64 shown in the '104 patent obviates the need for plug 68 of the '104 patent and thus avoids the reliability and cost disadvantages associated with that plug. Collar 24 could not be made of open cell plastic foam because that material is not strong and durable enough. If collar 24 were made of open cell foam, it would soon be torn out or wear out of channel 27. By contrast, Porex #5285 is strong and rugged enough to withstand the abuse that collar 24 will receive in a vehicle-body repair shop.

Using collar 24 also increases the surface area through which the exhaust stream exits (when compared to the cross-sectional area of openings 62 of the '104 patent), which reduces the velocity of the exhaust stream and the noise caused by the exhaust. Because air exiting exhaust port 41 can circulate throughout the entire space within channel 25, the entire surface area of collar 24 can operate as an exhaust opening. As air penetrates the inner surface of collar 24, the pores within collar 24 further diffuse the air flow and reduce the pressure variations that embody noise. The result is an air flow exiting vacuum ejector/stop 22 that is much quieter and less likely to agitate debris.

Vacuum ejector/stop 22 may be machined from impact steel, aluminum, or other appropriate materials by boring and tapping an appropriate series of holes. For instance, pressure source opening 34 is formed by drilling an opening into vacuum ejector face 37. Pressure source opening 34 carries threads that engage jet body 26 and also functions as venturi chamber 35 to which pressure source jet 30 (through pressure diffuser 32), exhaust passage 38 (through exhaust inlet nozzle 36), and vacuum passage 40 are connected. Because pressure source opening 34 is of sufficient diameter, exhaust inlet nozzle 36, exhaust passage 38, and vacuum passage 40 may be drilled through pressure source opening 34 without removing more material from vacuum ejector face 37. Moreover, no is required to seal venturi chamber 35.

Figure 2:
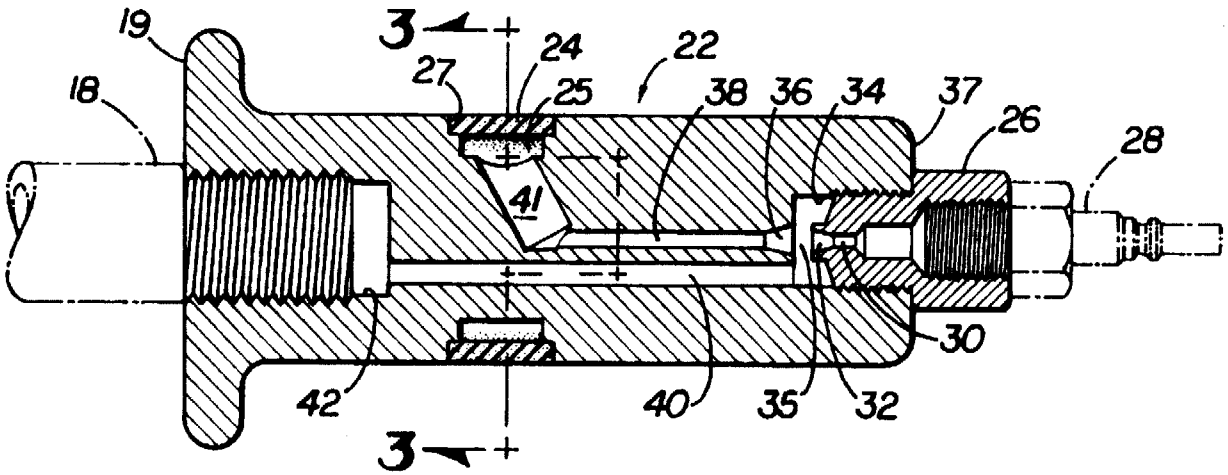
FIG. 2 is a side elevation view, in section, of the vacuum ejector/stop portion of the present invention shown in FIG. 1.

Slide tube opening 42 is drilled through vacuum ejector face 19, and a portion of slide tube opening is threaded to engage slide tube 18 as best shown in FIG. 2. Slide tube opening 42 is also connected to vacuum passage 41 so that low pressure in venturi chamber 35 and vacuum passage 41 is transmitted to slide tube 18 and suction cup 16.

Vacuum ejector/stop 22 employs the venturi effect to generate a partial vacuum. High pressure air passes through pressure source jet 30, pressure diffuser 32, venturi chamber 35, exhaust nozzle 36, exhaust passage 38, and exhaust port 41 before circulating through channel 25 and exiting through collar 24. As the high pressure air passes from pressure diffuser 32 to exhaust nozzle 36, it reduces the pressure in venturi chamber 35 and thus vacuum passage 40, slide tube opening 42, slide tube 18, and suction cup 16.

Although vacuum ejector/stop 22 may be successfully produced utilizing a number of different configurations, the configuration shown in FIGS. 1, 2, and 3 was found to be successful with the following dimensions: Vacuum ejector/stop 22 is a 4.55-inch long circular cylinder, generally of 1.500 inches in diameter, with vacuum ejector face 37 on one end and a flange on the other end that is 0.325 inches thick, is 2.500 inches in diameter, and has a vacuum ejector face 19. Pressure source opening 34 is drilled 0.750 inches deep through vacuum ejector face 37 and tapped to accept ⅝-inch×18 threads. Passage 38 is 0.140 inches in diameter and is drilled through the center of pressure opening 34 1.940 inches farther into vacuum ejector/stop 22. Exhaust nozzle 36 is 0.159 inches in diameter at its opening and tapers to 0.140 inches in diameter to mate with exhaust passage 38. Vacuum passage 40 is drilled through the innermost surface of pressure opening 34, is 0.1875 inches in diameter, and is centered 0.310 inches below the center of exhaust passage 38. Slide tube opening 42 is drilled through vacuum ejector face 19, connects to vacuum passage 40, and is threaded to accept slide tube 18.

Jet body 26 is preferably formed of either C360 brass or 303 or 304 stainless steel and includes a hex-nut surface that is threaded externally on one end to mate with pressure source opening 34 and tapped internally on the other end with ¼-inch threads that mate with standard air fitting 28 Progressively narrower concentric nozzles are drilled through jet body 26 until the passage through jet body 26 narrows to pressure source jet 30 of 0.060 inches in diameter. The passage through jet body 26 then opens to pressure diffuser 32 with a maximum diameter of 0.110 inches.

Channel 27, which machined into the surface of vacuum ejector/stop 22, is 0.625 inches wide, 0.125 inches deep, and its center is 2.2625 inches from vacuum ejector face 37. Channel 25, which is machined into channel 27, is 0.500 inches wide, 0.125 inches deep, and centered in channel 27. Exhaust port 41 is a 0.375-inch diameter port that is drilled through channel 25 at an angle so that it connects to exhaust passage 38. After channel 25 is machined, collar 24, which is preferably made of Porex #5285, is cut into a 0.625-inch long tubular section with a 1.500-inch outside diameter and 0.125-inch thick walls. This tubular section, which forms collar 24, is cut to allow collar 24 to be spread apart and installed within channel 27. After installation, the cut in collar 24 is glued with an epoxy (e.g., Devon two-ton clear epoxy 14-310) so that collar 24 is permanently fixed within channel 27.

As is readily apparent from the description above, attachment of suction cup 16 to a dented panel is accomplished by establishing a partial vacuum within suction cup 16, and it is removed by restoring normal air pressure within suction cup 16 or increasing the pressure there to an above normal level. This may be accomplished in the embodiment of the present invention illustrated in FIG. 1, among other ways, by supplying and removing the air source to vacuum ejector/stop 22. This may be conveniently accomplished by use of a combination valve and coupling 74. Alternative means of selectively controlling the air pressure within suction cup 16 to permit rapid attachment and removal of the cup 16 from a work piece were illustrated in FIGS. 7, 8, and 9 of the '104 patent and may also be employed in vacuum ejector/stop 22. Use of such an easily operated control will permit the operator to "walk" the suction cup along a panel or workpiece in order to work several spots on the panel in quick succession.

Figure 4:
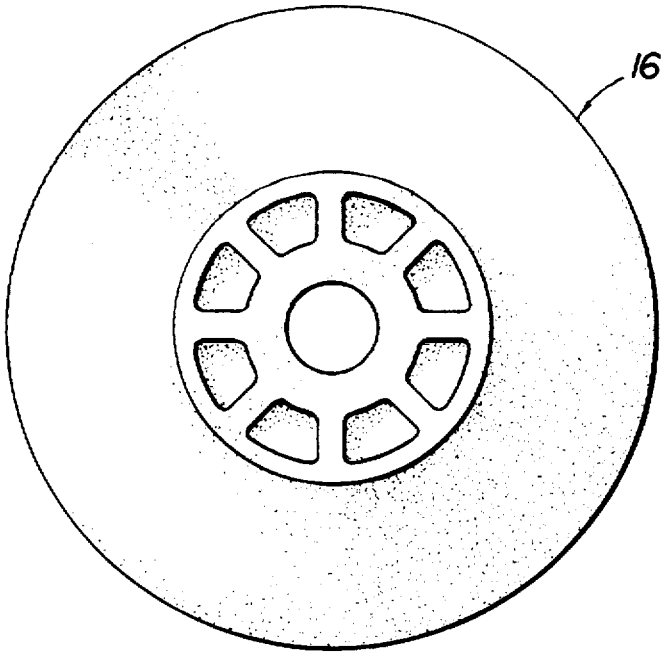
FIG. 4 is plan view from above of a suction cup suitable for use on a dent removing tool according to the present invention.
Figure 5:
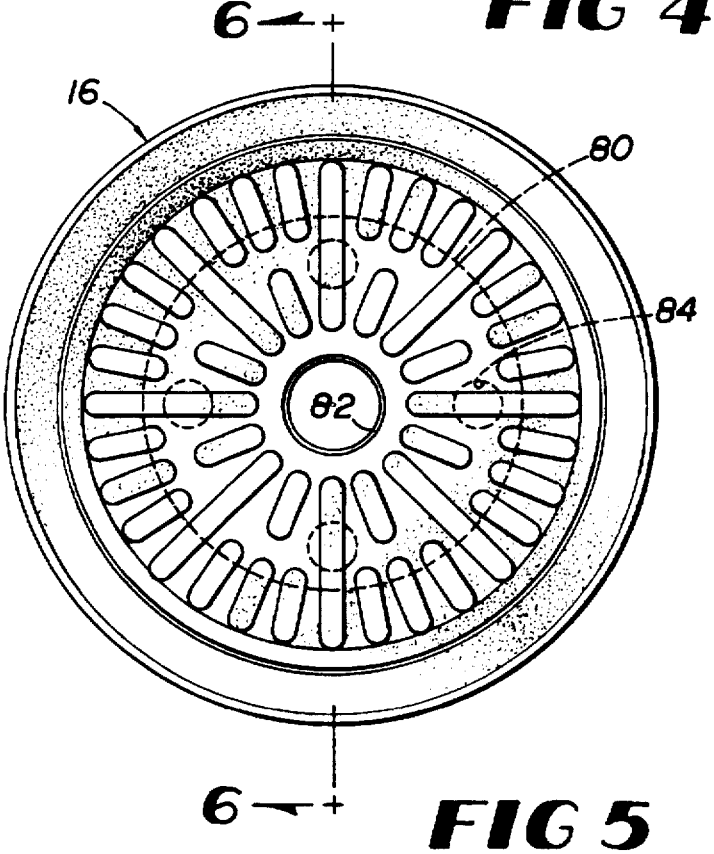
FIG. 5 is a plan view from below of the suction cup shown in FIG. 4 in which hidden lines represent an internal stiffener according to the present invention.
Figure 6:
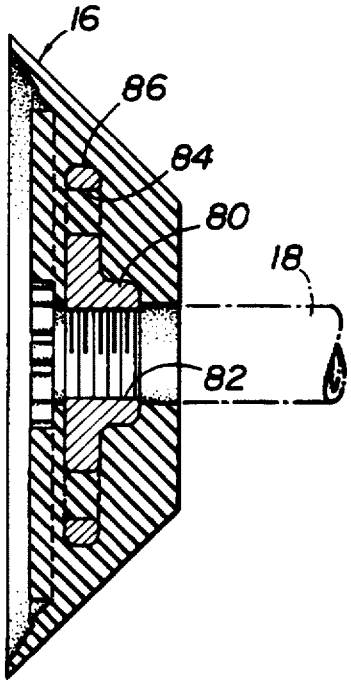
FIG. 6 is a sectional view of the suction cup shown in FIGS. 4 and 5 taken along line 6—6.

Suction cup 16 is illustrated in detail in FIGS. 4–6. As is best seen in FIG. 6, suction cup 16 is integrally molded around stiffener 80, which is preferably made of aluminum (e.g., 6061 T6) although other materials may also be suitable. Slide tube 18 has a threaded end which mates with in internally threaded bore 82 in stiffener 80. Stiffener 80 also has at least one stabilizing bore 84 through flange 86. As suction cup 16 is molded around stiffener 80, liquid rubber flows through stabilizing bore 84. After the rubber hardens, the rubber passing through stabilizing bore 84 prevents stiffener 80 from rotating relative to suction cup 16. Stiffener 80 has been found to significantly improve the durability of the connection of suction cup 16 to slide tube 18 because the stiffener bears loads in both axial directions (i.e., when slide tube 18 pushes on suction cup 16 and when slide tube 18 pulls on suction cup 16). The resulting combination of suction cup 16 and stiffener 80 is a permanently integrated component having all the resilience required to adequately provide a suction fit to a body panel and the stiffness and structural integrity required to withstand the repeated shocks transmitted to the suction cup 16 when slide hammer 20 strikes vacuum ejector/stop 22.

In all embodiments of the present invention, a substantial reduction of air pressure is established on the slide hammer assembly 10 side of a panel being worked by the combination of (1) the reduced pressure within suction cup 16 resulting from withdrawal of air from the cup is 16 and (2) force applied to draw suction cup 16 in the direction away from the panel by vigorously sliding hammer 20 against vacuum ejector/stop 44 or vacuum ejector/stop 22, thereby distorting cup 16 and thus increasing the volume of the air inside of cup 16. Such reduction of air pressure on the tool side of the panel will permit ambient air pressure on the opposite side of the panel to push the panel in the direction of the tool, thereby returning a dented panel to its original contour as the ambient air pressure urges the panel to "follow" the direction of movement of the suction cup 16.

The preceding description and drawings of the present invention are provided for purposes of explanation and illustration. It will be apparent to those skilled in the relevant art that modifications and changes may be made to the invention as described without departing from its scope and spirit.

I claim:

1. A sheet material working tool with a longitudinal axis comprising:

a. a slide tube having a suction cup mounted on one end;

b. a combination vacuum ejector and stop that is mounted on the other end of the slide tube, which vacuum ejector comprises:

i. a vacuum passage communicating with partial vacuum in the creating a partial vacuum in the suction cup during use and ii. an exhaust port through which an exhaust stream exits to the atmosphere during use;

c. a slide hammer mounted to slide along the tube and impact the vacuum ejector; and d. a block of solid, sturdy, porous muffling material interposed between the exhaust port and the atmosphere to muffle and diffuse the exhaust stream.

2. The sheet material working tool of claim 1 in which:

a. the vacuum ejector further comprises:

i. a round cylindrical outer surface that is symmetrical about the longitudinal axis; and ii. a first channel having a first width that is wider than the largest diameter of the exhaust port, which first channel A. is in the outer surface, B. is symmetrical about the longitudinal axis, C. communicates with the exhaust port; and b. the block of muffling/diffusing material is a collar positioned in the first channel.

3. The sheet material working tool of claim 1, in which the vacuum ejector further comprises:

a. a generally round cylindrical outer surface that is substantially symmetric about a longitudinal axis of the vacuum ejector;

b. a flange located at a first end that is generally flat and circular, which flange is generally circular and symmetric about the longitudinal axis;

c. a second end that is generally flat and circular;

d. a slide tube opening in the first end of the vacuum ejector that is connected to the vacuum passage;

e. a pressure source opening in the second end of the vacuum ejector;

f. a venturi chamber connected to the pressure source opening and the vacuum passage; and g. an exhaust passage connected to the exhaust port and the venturi chamber wherein the slide tube opening is formed through the first end and the pressure source opening, the venturi chamber, and the exhaust passage are formed through the second end.

4. The sheet material working tool of claim 2, in which the block of muffling material is formed of Porex#5285.

5. The sheet material working tool of claim 2, in which the vacuum ejector further comprises a second channel cut into the first channel with a second width less than the first width.

6. The sheet material working tool of claim 5, further comprising a stiffener embedded within the suction cup.

7. The sheet material working tool of claim 6 further comprising a shock absorbing hose connected to the combination vacuum ejector and stop.

8. A sheet material working tool with a longitudinal axis comprising:

a. a slide tube;

b. a suction cup mounted on a first end of the slide tube and defining an internal cavity;

c. a stiffener located within the internal cavity of the suction cup;

d. a combination vacuum ejector and stop that is mounted on a second end of the slide tube, which vacuum ejector comprises:

i. a vacuum passage communicating with the slide tube thereby creating a partial vacuum in the suction cup during use and ii. an exhaust port through which an exhaust stream exits to the atmosphere during use; and e. a slide hammer mounted to slide along the tube and impact the vacuum ejector.

9. The sheet material working tool of claim 8, in which the stiffener comprises a disk having a mounting bore located at substantially the center of the disk and adapted to mate with the first end of the slide tube.

10. The sheet material working tool of claim 9, in which the suction cup further comprises an internal protrusion located within the internal cavity and the stiffener further comprises a stabilizing bore at a location radially displaced from the mounting bore and adapted to prevent the stiffener from rotating relative to the suction cup by mating with the internal protrusion of the suction cup.

11. The sheet material working tool of claim 10, further comprising a shock absorbing hose connected to the combination vacuum ejector and stop.

12. The sheet material working tool of claim 11, further comprising a block of solid, sturdy, porous muffling material interposed between the exhaust port and the atmosphere to muffle and diffuse the exhaust stream.

13. The sheet material working tool of claim 8, further comprising a shock absorbing hose connected to the combination vacuum ejector and stop.

14. The sheet material working tool of claim 13, further comprising a block of solid, sturdy, porous muffling material interposed between the exhaust port and the atmosphere to muffle and diffuse the exhaust stream.

15. The sheet material working tool of claim 8, further comprising a block of solid, sturdy, porous muffling material interposed between the exhaust port and the atmosphere to muffle and diffuse the exhaust stream.

16. A sheet material working tool, comprising:

a. a slide tube;

b. a suction cup mounted on a first end of the slide tube;

c. a combination vacuum ejector and stop that is mounted on a second end of the slide tube, which vacuum ejector comprises:

i. a vacuum passage communicating with the slide tube thereby creating a partial vacuum in the suction cup during use and ii. an exhaust port through which an exhaust stream exits to the atmosphere during use;

d. a fitting connected to the combination vacuum ejector and stop;

e. a shock absorbing hose connected to the fitting and adapted to be connected to a source of high pressure air via a separate supply hose; and f. a slide hammer mounted to slide along the tube and impact the vacuum ejector.

17. The sheet material working tool of claim 16, in which the end of the fitting is externally threaded and has a progressively larger diameter moving from the distal end of the fitting toward a proximal end at which the fitting mates with the shock absorbing hose.

18. The sheet material working tool of claim 17, further comprising a stiffener embedded within the suction cup.

19. The sheet material working tool of claim 18, further comprising a block of solid, sturdy, porous muffling material interposed between the exhaust port and the atmosphere to muffle and diffuse the exhaust stream.

20. A sheet material working tool comprising:

a. a slide tube having a suction cup mounted on one end;

b. a combination vacuum ejector and stop that is mounted on the other end of the slide tube, which vacuum ejector/stop comprises:

i. a vacuum passage communicating with the slide tube thereby creating a partial vacuum in the suction cup during use, ii. an exhaust port through which an exhaust stream exits to the atmosphere during use, iii. a generally round cylindrical outer surface that is substantially symmetric about a longitudinal axis of the vacuum ejector/stop, iv. a first end that is generally flat, circular, and symmetric about the longitudinal axis, v. a second end that is generally flat, circular, and symmetric about the longitudinal axis, vi. a slide tube opening in the first end of the vacuum ejector/stop that communicates with the vacuum passage and the slide tube, vii. a pressure source opening in the second end of the vacuum ejector/stop, viii. a venturi chamber connected to the pressure source opening and the vacuum passage, and ix. an exhaust passage connected to the exhaust port and the venturi chamber, wherein the slide tube opening is formed through the first end and the pressure source opening, the venturi chamber, and the exhaust passage are formed through the second end, and the exhaust port is formed through the outer surface; and c. a slide hammer mounted to slide along the tube and impact the vacuum ejector/stop.

* * * * *